US005836734A

United States Patent [19]

Doering

[11] Patent Number: 5,836,734

[45] Date of Patent: Nov. 17, 1998

[54] LATCHING DEVICE WITH DETENT

[75] Inventor: David Arthur Doering, Knoxville, Tenn.

[73] Assignee: Deere & Company, Moline, Ill.

[21] Appl. No.: 953,760

[22] Filed: Oct. 17, 1997

[51] Int. Cl.[6] ..... E02F 3/70

[52] U.S. Cl. ..... 414/723; 414/722

[58] Field of Search ..... 414/685, 723, 414/680, 722

[56] References Cited

U.S. PATENT DOCUMENTS

| | | | |
|---|---|---|---|
| 3,794,195 | 2/1974 | Clevenger et al. | 414/723 |
| 3,876,091 | 4/1975 | MacDonald . | |
| 3,907,142 | 9/1975 | Welch | 414/723 |
| 3,985,249 | 10/1976 | Aker et al. . | |
| 4,067,467 | 1/1978 | Datta et al. . | |
| 4,068,959 | 1/1978 | Pemberton | 403/15 |
| 4,085,856 | 4/1978 | Westendorf . | |
| 4,119,225 | 10/1978 | Macht et al. | 414/723 |
| 4,136,792 | 1/1979 | Wilson . | |
| 4,236,861 | 12/1980 | Grove | 414/680 |
| 4,488,850 | 12/1984 | Wernimont | 414/723 |
| 4,545,720 | 10/1985 | Cochran et al. | 414/723 |
| 4,929,143 | 5/1990 | Dohnalik | 414/723 |
| 4,986,722 | 1/1991 | Kaczmarczyk et al. | 414/723 |
| 5,082,065 | 1/1992 | Fletcher | 172/273 |
| 5,141,385 | 8/1992 | Tibbatts et al. | 414/723 |
| 5,224,816 | 7/1993 | Kaczmarczyk | 414/723 |
| 5,263,810 | 11/1993 | Takekata et al. | 414/723 |
| 5,590,483 | 1/1997 | Kim | 414/723 |
| 5,634,735 | 6/1997 | Horton et al. | 403/322 |
| 5,634,736 | 6/1997 | Brown et al. | 403/322 |

OTHER PUBLICATIONS

Bobcat (Melroe), page from Model 753 Loader Parts Manual, page B5, publish date—unknown, published in USA.

Copies of photos by Deere & Co. employees, Copies of ten (10) photos of quick attach device on Bobcat (Melroe) model 753 loader, copies of ten (10) photos on five (5) pages, Publication date—1997, Published in USA.

Copy of one (1) Photo by Deere & Co. employees, Copy of one (1) one photo of Gehl Quick Attach Device from Model 5635SXT, Publication date—1997, Published in USA.

*Primary Examiner*—Karen M. Young
*Assistant Examiner*—Gregory A. Morse

[57] ABSTRACT

A latching device is provided for coupling a vehicle tool carrier with a variety of tools such as a bucket. The device serves to releasably secure the tool with the carrier once the carrier has been positioned with the tool. A detent mechanism is provided on the device to retain it in either its latched or unlatched position. A lost-motion connection is provided between the latching handle and latch pin to permit the link interconnecting the handle and pin to move to an over-center position when the device is in the latching configuration. A spring serves to hold the link in its over-center position. The latch handle swings through an angle of approximately 70 degrees as it moves between its latched and unlatched positions to minimize interference with the carrier and tool structures and simplify activation by the operator from his seat.

10 Claims, 7 Drawing Sheets

LATCHING DEVICE WITH DETENT

FIELD OF THE INVENTION

The present invention relates to vehicles having lift arms such as skid-steer loaders, and more particularly to a quick attach device for releasably mounting a variety of working tools with a carrier mounted to the lift arms of such vehicles.

BACKGROUND OF THE INVENTION

Working vehicles such as skid-steer loaders frequently have tool carriers supported at the ends of their lift arms. These carriers are adapted to be attached to a variety of tools, such as a bucket. To simplify and expedite the mounting and removal of various tools, the carriers are equipped with quick-attach devices. These devices typically include positioning structures to orient and locate one part of the carrier relative to the tool as well as a latching structure to secure the tool to the carrier. The structures used to position and locate the carrier with the tool often take the form of a pair of spaced apart and downwardly opening mounting supports on the upper portion of the tool designed to receive a compatibly spaced apart pair of upwardly projecting carrier wedges configured to be received beneath the supports. Generally the supports and wedges are widely spaced on the tool and carrier to provide a stable mounting connection. To lock the tool to the carrier, movable latch pins are then provided below the positioning structure, and usually on the carrier, for being received in openings provided on the tool. The latch pins are typically inserted into and removed from the tool openings by swinging movement of a handle pivotally coupled with the pin.

Frequently the handles must be swung through angles varying between 90 and 180 degrees to unlatch the pins. Unless sufficient space is provided between the latch handles, the lift arms and the positioning structures on the carrier to permit the handles to swing through the wide angle, interference can result. To provide sufficient clearance for the handles to swing between their latching and unlatching positions, additional fore and aft space is often added to the carrier. While this overcomes the interference problem, it results in the tool and its load being fore and aft spaced further in front of the loader and consequently reduces the stability of the loader when extending or raising a loaded tool. Further, adding additional fore and aft space to the carrier reduces the ability of the operator to reach the handles from his seat.

An additional problem can occur if the handles are not provided with means to retain them in either the latched or unlatched position. If they are not retained in the unlatched position, either someone else must hold the handle in its unlatched position while the operator removes the tool or the operator is forced to dismount, secure the handle in its unlatched position, then remount to detach the tool from the carrier. Alternatively, the handles must be moved to the unlatched position by a second person while the operator manipulates the tool carrier to detach it from the tool. If it is not retained in the latched position, then any inadvertent unlatching could result in the tool and carrier coming apart during operation.

SUMMARY OF THE INVENTION

Accordingly, it would be desirable to provide a handle activated latching structure for use between a loader carrier and tool wherein the handle swings through a short angle as it moves the latching pin between its latched and unlatched positions. Further, it would be desirable to provide a detent for the handle to secure it in either its latched or unlatched position. Additionally, it would be desirable to provide a latching device that allows the tool and its load to be positioned closer to the loader to improve the stability of the loader when the loaded tool is extended in front of the loader and to provide an activating handle closer to the operator to allow him to activate it from his seat.

Toward these ends, there is provided a latching device having a handle activated latching pin structure. The handle is pivotally mounted to swing through an angle of approximately seventy degrees as it moves the latching pin between its latched and unlatched positions. Complimentary cam surfaces are provided between the handle and its pivotal mounting to serve as a detent to hold the handle in either its latched or unlatched position. The cam surfaces are spring loaded towards each other to retain the cams in either of their engaged positions. The handle is mounted to move to a spring loaded over-center position when latched to further secure it in its latched position.

The short angle required to move the handle between its latched and unlatched positions avoids interference between it and the tool or lift arms, thereby allowing the latching handle and tool to be placed closer to the loader. With the handle closer to the loader and angled towards the loader, the operator can activate it from his seat. Two spaced apart latching devices are provided at spaced apart positions on the carrier to better secure the tool to the carrier.

DESCRIPTION OF THE PREFERRED EMBODIMENT

Figure 1:
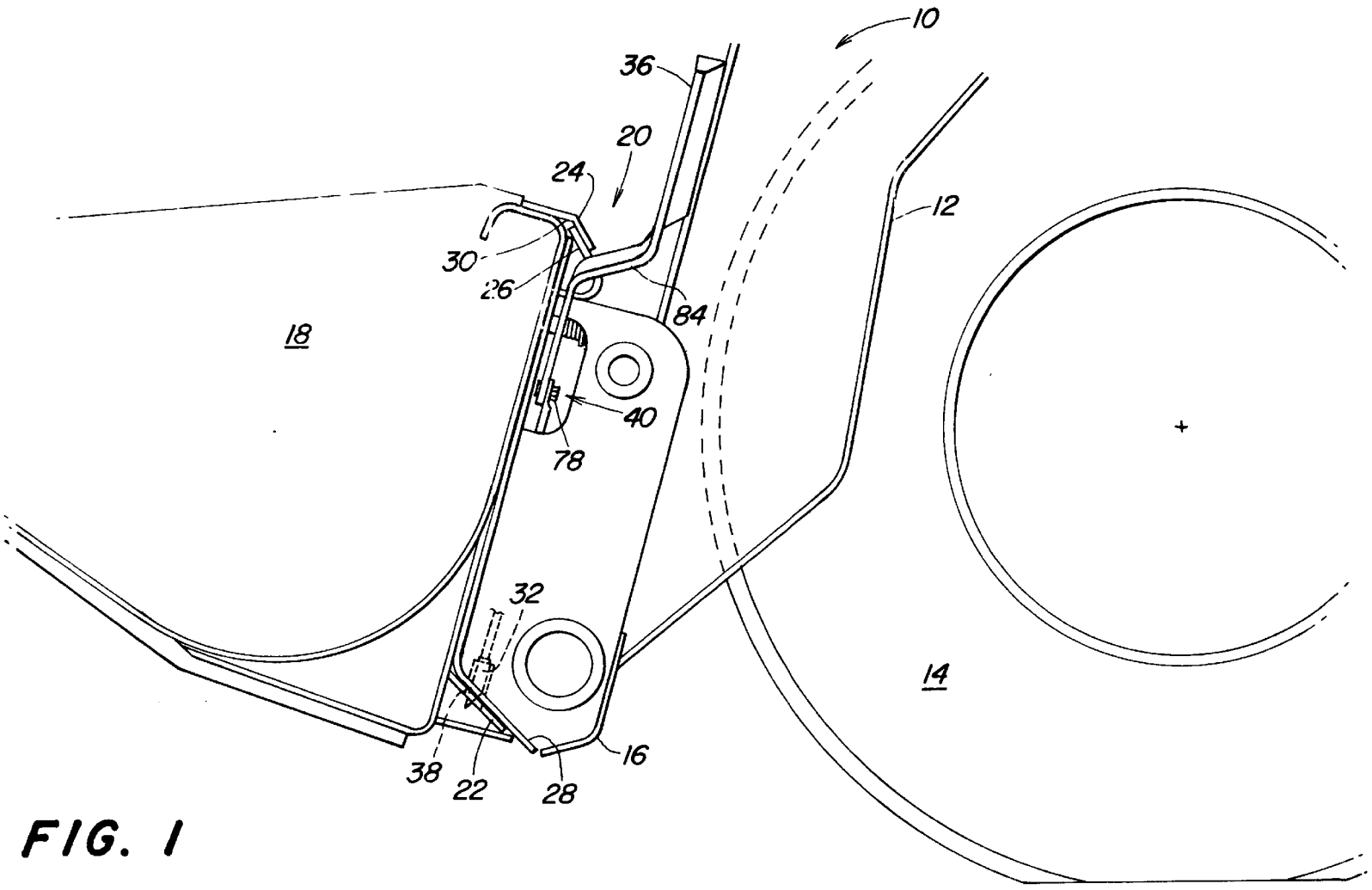
FIG. 1 is a schematic side view illustrating the invention utilized with a vehicle such as a skid-steer loader and a bucket.

Looking first to FIG. 1, there is shown in schematic form the forward portion of a vehicle such as a skid-steer loader 10, its lift arms 12 and front wheel 14. Attached to the lift arms 12 is a tool carrier 16 which is adapted for being readily connected to and is connected from a tool such as the bucket 18 illustrated. While the carrier 16 commonly supports two laterally spaced-apart structures adapted to readily connect and disconnect the working tool or bucket 18, FIG. 1 illustrates just those structures on the right side for discussion. These structures include positioning structures on the tool 18 and carrier 16 for orienting the carrier 16 for attachment to the tool 18 and a latching device 20 for securing the tool 18 to the carrier 16.

The positioning structures on the tool 18 include upwardly extending ramp plates 22 at the lower portion of the tool 18 and downwardly extending mounting support plates 24 at the top of the tool 18. Hydraulic cylinders, which are not shown, are provided between the lift arms 12 and carrier to tilt the carrier 16 and orient it with respect to the tool 18 so that the carrier's upwardly extending ramp plates 26 can be slidably positioned beneath the tool's downwardly extending support plates 24 . As the cylinders are activated to position the carrier's upwardly extending plates 26 beneath the tool's support plates 24, the bottom ramp plate 28 of the carrier 16 will slideably move along the bottom ramp 22 of the tool 18 to guide the carrier's plates 26 up and into the recess 30 beneath the tool's support plates 24.

Once the carrier 16 has been positioned, it must be attached to the tool 18. For this purpose, the latching device 20 is provided on each lateral side of the carrier 16 to secure that side of the carrier 16 with its respective side of the tool 18. Each latching device 20 utilizes a latch pin 32 that is mounted in a vertically extending sleeve 34 secured to the carrier 16. This latch pin 32 is moved vertically by a T-shaped latch handle 36 to insert it into or remove it from an opening 38 provided in the bottom ramp surface 22 of the tool 18 and secure the carrier 16 with the tool 18.

Figure 3:
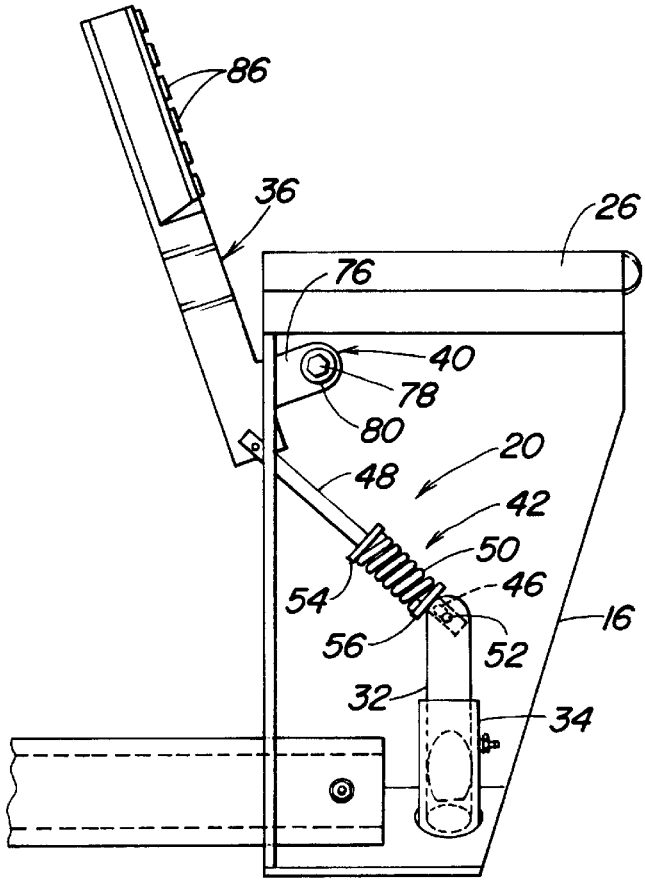
FIG. 3 is a rear schematic view of the latching device in its unlatched position.
Figure 2:
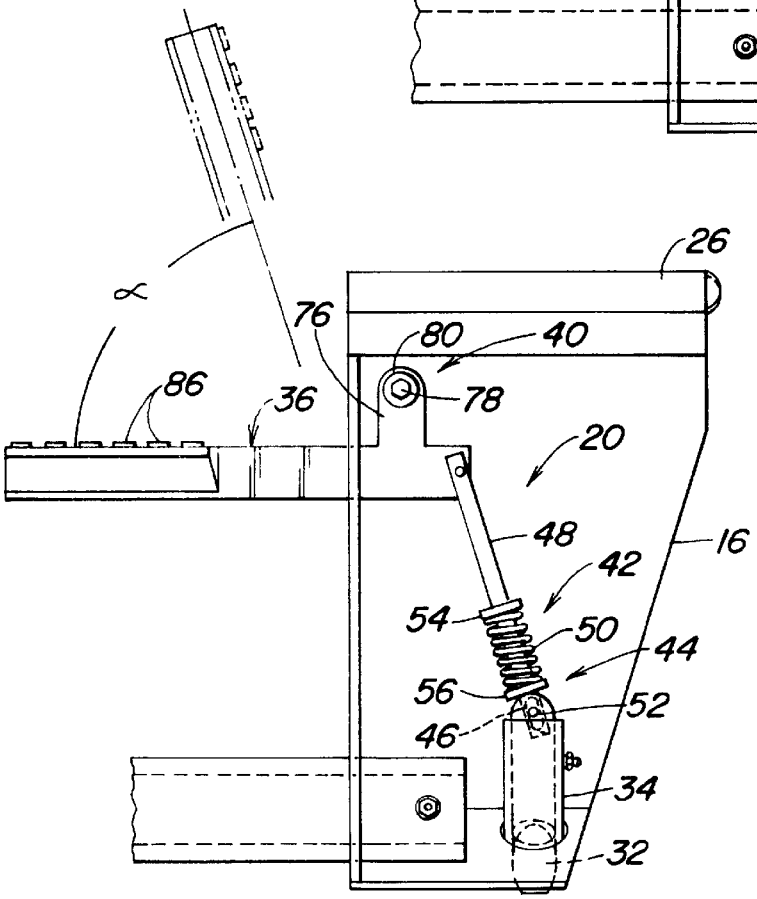
FIG. 2 is a rear schematic view of the latching device in its latched position.
Figure 6:
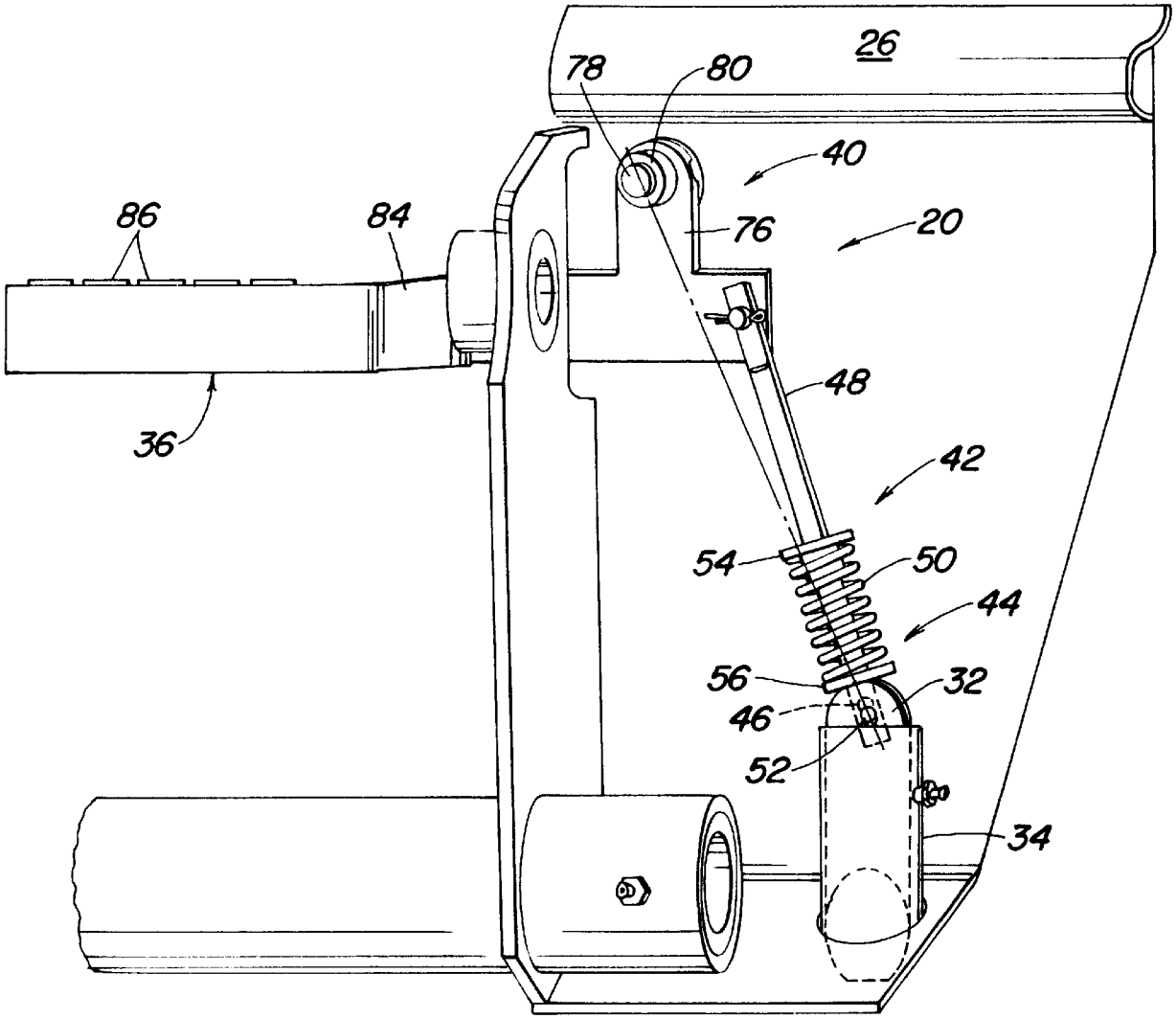
FIG. 6 is a rear perspective view of the latching device in its latched position.

Looking now to FIGS. 2 and 3, which illustrate the latching device 20 in its latched and unlatched positions, it will be seen that the latch handle 36 is pivotally mounted on a pivot support 40 secured to the carrier 16. The handle 36 is mounted for swinging movement between first and second positions illustrated respectively in FIGS. 2 and 3. Pivotally connected with the handle 36 is a link means 42 that interconnects the handle 36 and the pin 32 so that the pin 32 can be slideably moved between its latched and unlatched positions. The link means 42 includes a lost motion connection 44 between it and the pin 32. The lost-motion connection 44 includes a slot 46 in the link 48 to permit relative movement between the link 48 and pin 32 and a spring 50 that operates to urge the link 48 away from the connecting pin 52 coupling it to the latch pin 32. A washer 54 is secured to the link 48 and abuts the spring 50 on its one end. The other end of the spring 50 abuts a second washer 56 that is slidably mounted on the link 48 and abuts the connecting pin 52 coupling the link 48 and latch pin 32. This lost motion connection 44 permits the link 48 to move over-center as the handle 36 is moved from its unlatched to its latched position and the spring 50 serves to bias the link 48 away from the latch pin 32 and hold the link 48 in the over-center position and the handle 36 in its latched position, as is illustrated in FIGS. 2 and 6.

Figure 4:
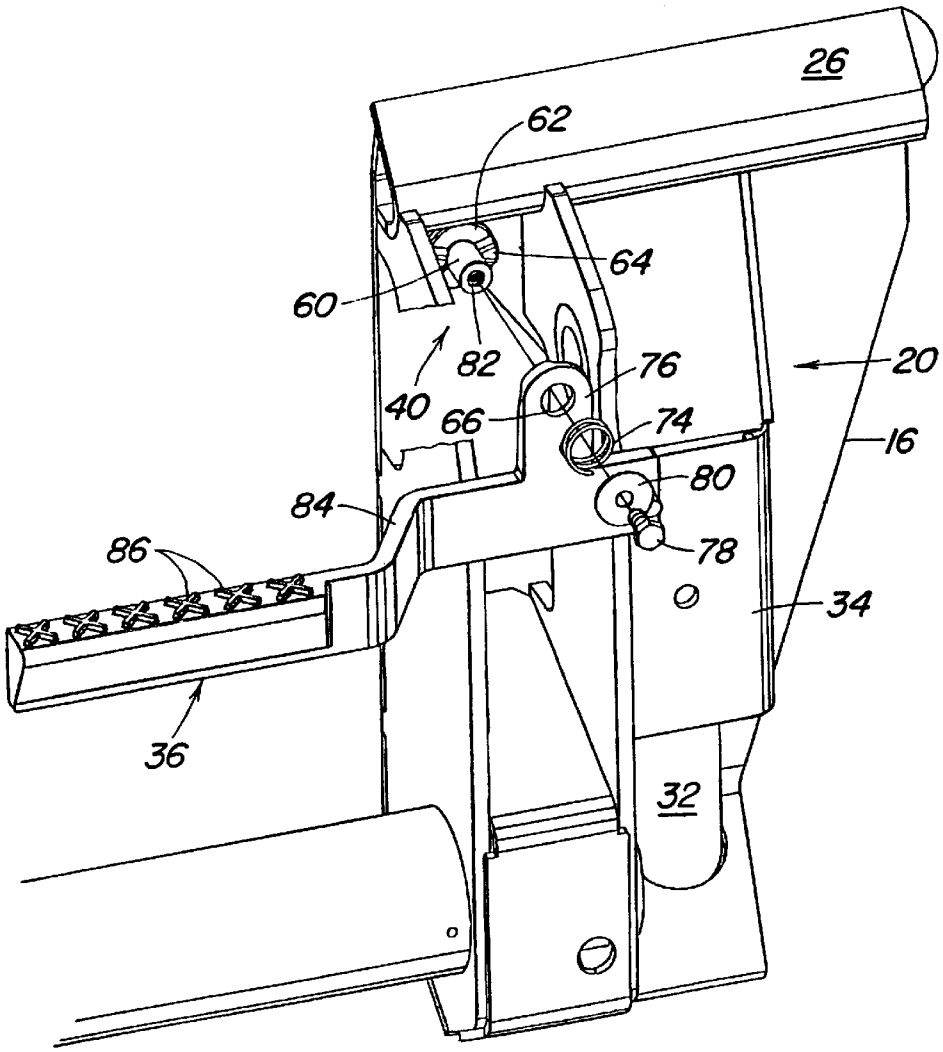
FIG. 4 is a rear elevated and exploded perspective view of the pivot mounting for the latching device.
Figure 5:
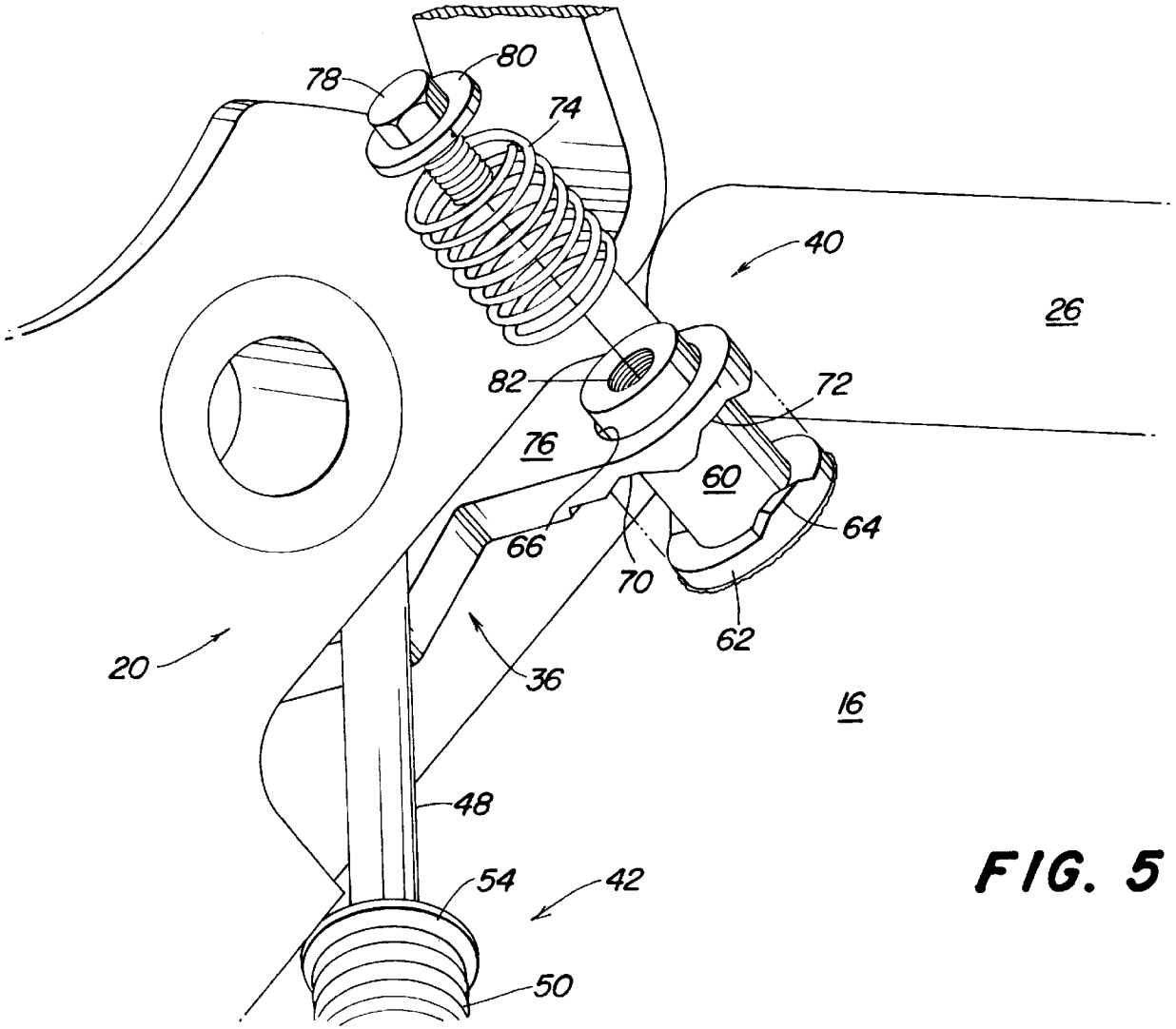
FIG. 5 is an enlarged and exploded perspective view illustrating the pivotal mounting structure and cam surfaces.
Figure 7:
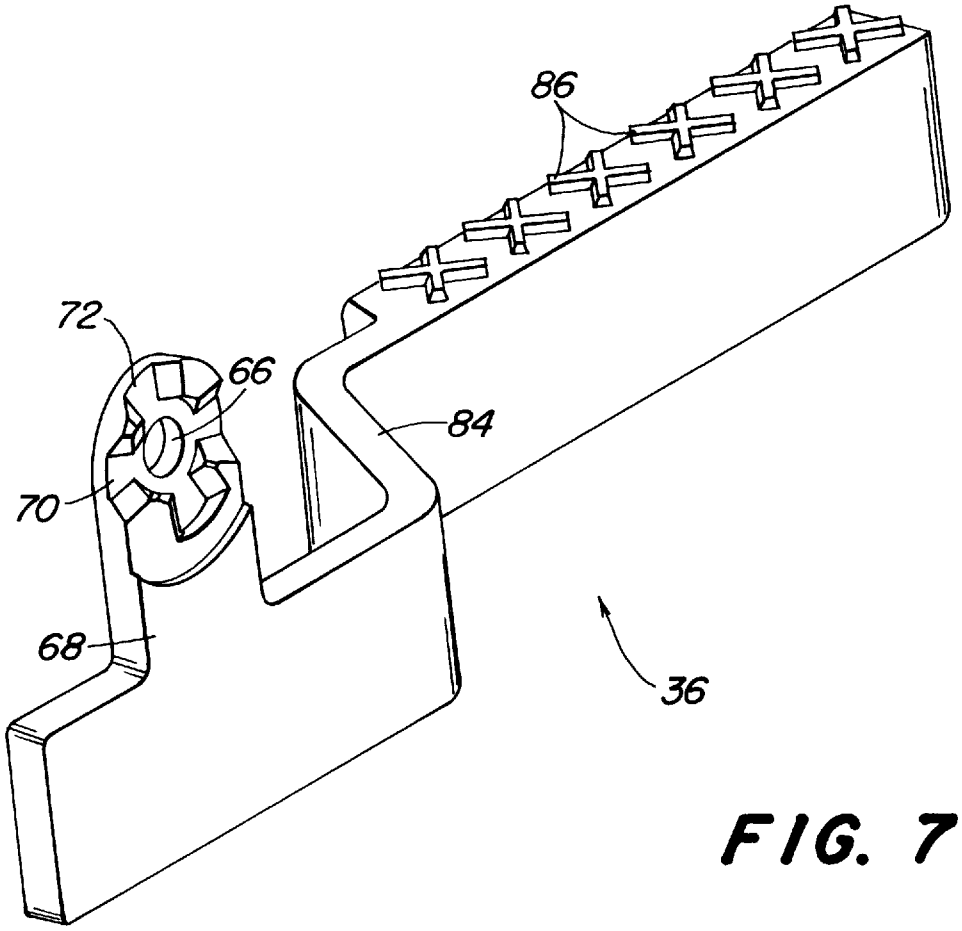
FIG. 7 is an enlarged view of the latching handle illustrating the cam surfaces.

Looking now to FIGS. 4 and 5, there is illustrated the pivot support 40 for the latch handle 36. This support 40 includes a shaft 60 having a base 62 that is secured by welding to the carrier 16. The shaft 60 and base 62, in the preferred embodiment, take the form of a powdered metal part with the base 62 having first cam surfaces 64. The latch handle 36 is provided with an opening 66 that is sized to receive the shaft 60. As is best shown in FIG. 7, the undersurface 68 of the handle 36 has second and third cam surfaces 70, 72 formed thereon. A biasing means taking the form of a spring 74 is provided between the top surface 76 of the handle 36 and a bolt 78 and washer 80 are provided to secure that latch handle 36 to the pivot support shaft 60. As is seen in FIG. 5, the pivot shaft 60 is provided with internal threads 82 for securing the bolt 78 thereto.

Looking again to FIG. 7 and the latch handle 36 illustrated therein, it should be noted that the handle 36 includes an offset leg 84 intended to extend it away from the tool 18 and towards the vehicle 10, thereby making it easier for the operator to reach. Further provided on the handle 36 are raised surfaces 86 intended to provide a better frictional grip.

Looking back to and comparing FIGS. 2 and 3, it can be seen that the latch handle 36 moves through an angle $\alpha$ of approximately 70 degrees as it swings between its latched (FIG. 2) and unlatched (FIG. 3) positions. When the handle 36 is in its latched position, the latch pin 32 extends through the opening 38 in the bottom ramp surface 22 of the tool 18 to secure the carrier 16 with the tool 18, see FIG. 1, and the link 48 is an over-center position, see FIG. 6. The lost motion connection 44 and spring 74 serve to push the handle 36 away from the latch pin 32 and urge the latch handle 36 toward its latched position. This feature assists in assuring that the latch handle 36 remains in the latched position.

Figure 8:
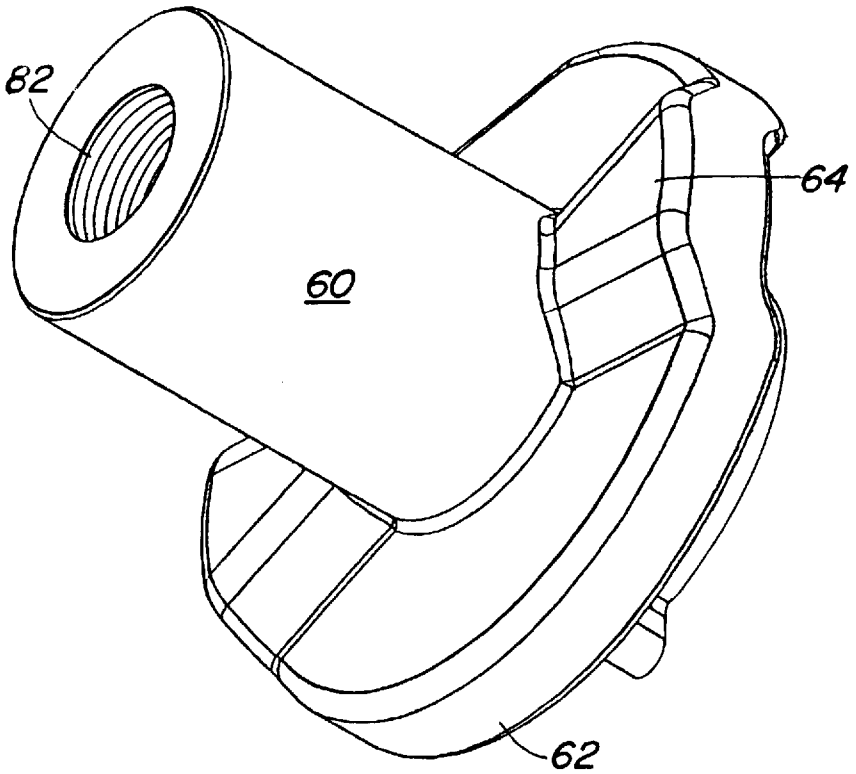
FIG. 8 is an enlarged view of the pivot shaft and base.

Further serving to retain the latch handle 36 in either of its selected positions, that is either the latched or unlatched configuration, is a detent means provided between the pivot support 40 and the latch handle 36. The detent means takes the form of the first, second and third cam surfaces 64, 70, 72, see FIGS. 5, 7 and 8. The first cam surface, on the base 62 of the pivot support 40, is identified by the number 64. The second and third cam surfaces on the undersurface 68 of the latch handle 36 are identified by the numbers 70 and 72, see FIGS. 5 and 7. When the latching device 20 is in its latched position as shown in FIGS. 2, and 6, the first cam surfaces 64 will be engaged with the second cam surfaces 70 on the underside 68 of the latch handle 36. The spring biasing means 74 provided above the latch handle 36 serves to hold the cam surfaces 64 and 70 in contact and thereby hold the latching device 20 in its latched position.

When the operator wants to move the latching device 20 to the unlatched configuration illustrated in FIG. 3, he moves the handle 36 to the raised position to lift the pin 32 out of the hole 38 and slide it upwardly in the sleeve 34. During this movement the link means 42 will move from the over-center position illustrated in FIGS. 2 and 6 to the position illustrated in FIG. 3. Further, the first and second cam surfaces 64 and 70 will be slideably disengaged as the handle 36 is moved to its FIG. 3 orientation and the first and third cam surfaces 64 and 72 will come into engagement. With the spring 74 biasing these first and third cam surfaces 64 and 72 toward engagement, the handle 36 will be retained in its unlatched orientation to secure the pin 32 in its raised and unlatched orientation.

With the present invention there is provided a latching device with a detent that serves to retain the latching pin in either its latched or unlatched position. The handle is moved through an angle $\alpha$ of less than 90 degrees providing for minimum interference between the handle, the lift arm of the loader vehicle and the structure of the bucket, thereby providing a shorter extending structure on the carrier. Accordingly the tool can be placed closer to the vehicle and the load will be placed closer to the vehicle wheel, thereby providing a more stable support for lifting and moving the loaded tool.

I claim:

1. Latching means for releasably securing a vehicle carrier frame to a tool having an opening therein, said latching means including:

a latch pin mounted on the frame for movement between a first position where the pin projects into the opening of the tool and a second position where the pin is not in said opening;

a pivot support carried by the frame;

a latch handle supported by the pivot support for swinging movement between a first and a second position;

link means interconnecting the handle and pin so that the pin is moved between its first and second positions as the handle is respectively moved between its first and second positions;

detent between the handle and frame adapted to releasably secure the handle in either its first or second position, said detent including first, second and third cam surfaces, the first cam surface being supported by the pivot support, the second and third cam surfaces being supported by the handle, and a spring for urging the second and third cam surfaces towards engagement with the first cam surface as the handle is moved between its first and second positions.

2. The invention defined in claim 1 wherein the link means includes a lost-motion means that allows it to be in an over center position when the latch pin is in its first position.

3. The invention defined in claim 2 wherein the link means is provided with biasing means urging the handle away from the pin.

4. The invention defined in claim 1 wherein the handle is adapted to swing through an angle of less that 75 degrees as it is moved between its first and second positions.

5. The invention defined in claim 1 wherein the handle includes an offset portion that extends away from the frame.

6. The invention defined in claim 1 wherein the latch pin is housed within a sleeve mounted on the frame for reciprocal movement between its first and second positions.

7. The invention defined in claim 1 wherein the first cam surface and pivot support are rigidly joined.

8. Latching means for releasably securing a vehicle carrier frame to a tool having an opening therein, said latching means including:

a latch pin slidably mounted on the frame for movement between a latched first position where the pin projects into the opening of the tool and an unlatched second position where the pin is not in said opening;

a pivot support carried by the frame;

a latch handle supported by the pivot support and coupled with the pin, the handle adapted to move the pin between its first and second positions as it is swingably moved between respective first and second positions;

a first cam surface carried on the pivot support;

second and third cam surfaces carried on the handle; and means biasing the second and third cam surfaces towards engagement with the first cam surface to retain the handle in either its first or second position.

9. The invention defined in claim 8 wherein a lost-motion link couples the handle and pin, and the link is in an over-center position when the handle is in its first position.

10. The invention defined in claim 9 wherein the angle through which the handle swings as it moves between it first and second positions is less than 75 degrees.

* * * * *